United States Patent [19]

Furrow et al.

[11] Patent Number: 4,988,224

[45] Date of Patent: Jan. 29, 1991

[54] UNIVERSAL RIBBON CARTRIDGE FOR HIGH-SPEED PRINTERS

[75] Inventors: Edward D. Furrow, Waynesboro; Leon C. Johenning, II, Lexington, both of Va.

[73] Assignee: Genicom Corporation, Waynesboro, Va.

[21] Appl. No.: 917,358

[22] Filed: Oct. 9, 1986

[51] Int. Cl.[5] ..... B41J 32/02

[52] U.S. Cl. ..... 400/194; 400/195

[58] Field of Search ..... 400/194, 195, 196, 196.1, 400/202, 207, 208, 208.1, 228, 231, 234, 235, 235.1, 247, 248, 249, 636, 636.1, 637.1, 639.1; 242/199

[56] References Cited

U.S. PATENT DOCUMENTS

| | | | |
|---|---|---|---|
| 2,873,051 | 2/1959 | Gray | 400/208.1 |
| 2,930,470 | 3/1960 | Roller et al. | 400/235.1 X |
| 3,621,968 | 11/1971 | Kondur, Jr. | 400/202 X |
| 3,720,954 | 3/1973 | Czyryk | 346/106 |
| 3,863,749 | 2/1975 | Perry et al. | 400/208 |
| 3,871,507 | 3/1975 | Perry et al. | 400/208 |
| 3,918,569 | 11/1975 | Parker | 400/235.1 X |
| 3,989,132 | 11/1976 | Carson, Jr. | 400/195 |
| 4,047,608 | 9/1977 | Willcox | 400/228 X |
| 4,051,944 | 10/1977 | Starr | 400/195 |
| 4,074,799 | 2/1978 | Hishida et al. | 400/234 X |
| 4,115,013 | 9/1978 | Hedstrom | 400/249 |
| 4,130,367 | 12/1978 | Guerrini et al. | 400/195 |
| 4,211,499 | 7/1980 | Hunt et al. | 400/639.1 X |
| 4,227,820 | 10/1980 | Falcetti | 400/195 |
| 4,232,976 | 11/1980 | Bernardis et al. | 400/196.1 |
| 4,240,757 | 12/1980 | Hanna | 400/196.1 |
| 4,247,209 | 1/1981 | Carlson et al. | 400/195 |
| 4,279,522 | 7/1981 | Yonkers | 400/196.1 |
| 4,284,364 | 8/1981 | Rello | 400/234 |
| 4,293,234 | 10/1981 | Yonkers et al. | 400/196.1 |
| 4,325,645 | 4/1982 | Miyajima et al. | 400/196.1 |
| 4,383,774 | 5/1983 | Yonkers | 400/195 |
| 4,383,775 | 5/1983 | Trammell et al. | 400/248 X |
| 4,388,006 | 6/1983 | Waibel | 400/195 |
| 4,397,574 | 8/1983 | Wojdyla | 400/235.1 X |

(List continued on next page.)

FOREIGN PATENT DOCUMENTS

| | | | |
|---|---|---|---|
| 0121971 | 10/1984 | European Pat. Off. | 400/208 |
| 0158963 | 10/1985 | European Pat. Off. . | |
| 2742974 | 3/1979 | Fed. Rep. of Germany | 400/249 |
| 0107877 | 7/1982 | Japan | 400/195 |
| 0001283 | 1/1984 | Japan | 400/248 |
| 0176082 | 10/1984 | Japan | 400/248 |

OTHER PUBLICATIONS

IBM Technical Disclosure Bulletin, vol. 28, No. 3, Aug. 1985, pp. 918–919, "Plastic Ribbon Guide,".

Precipart Corp., Division of American Laubscher Corp. brochure 4 pages.

Websters New Collegiate Dictionary, published by G. & C. Merriam Co., Springfield, Mass., 1961, p. 10.

IBM Technical Disclosure Bulletin, "Ribbon Guide and Shield for Wire Matrix Printer," Habich, vol. 26, No. 1, Jun. 1983, p. 73.

*Primary Examiner*—David A. Wiecking
*Assistant Examiner*—C. A. Bennett
*Attorney, Agent, or Firm*—Nixon & Vanderhye

[57] ABSTRACT

A ribbon movement controlling cartridge includes a smudge guard/ribbon guide which contains exposed ribbon in a fixed stationary position during cartridge transportation and storage. When the guide is engaged with a printhead, it releases ribbon passage therethrough and acts as a smudge guard/ribbon guide during normal cartridge usage. A Mobius loop forming structure (along a first path for fabric ribbons) includes a central aperture therethrough so as to alternately permit direct non-inverting ribbon passage through the same structure along a second path intersecting the first path, for carbon film-type ribbons. A limited usage metering and self-stopping mechanism insures against over-extended usage of the cartridge. A unique key locking tab arrangement permits a proper cartridge to be positively engaged with a printer while also permitting easy disengagement for cartridge removal and replacement.

22 Claims, 9 Drawing Sheets

U.S. PATENT DOCUMENTS 4,413,920 11/1983 Matthias et al. ..... 400/248
4,422,785 12/1983 Shore ..... 400/247 X
4,467,976 8/1984 Bogaczyk et al. ..... 242/67.3 R
4,486,107 12/1984 Wilcox ..... 400/208
4,492,484 1/1985 Akazawa et al. ..... 400/248
4,496,256 1/1985 McMorrow et al. ..... 400/248
4,507,668 3/1985 Horiya et al. ..... 400/208 X
4,572,683 2/1986 Hayashi ..... 400/208
4,602,883 7/1986 Ozawa et al. ..... 400/637.1
4,614,448 9/1986 Suzaki et al. ..... 400/208
4,630,948 12/1986 Karns ..... 400/234 X
4,636,097 1/1987 Goubeaux ..... 400/249 X
4,643,601 2/1987 Nash et al. ..... 400/208 X
4,650,355 3/1987 Cassiano et al. ..... 400/248 X
4,674,703 6/1987 Falk ..... 242/199
4,676,681 6/1987 Kikuchi et al. ..... 400/247

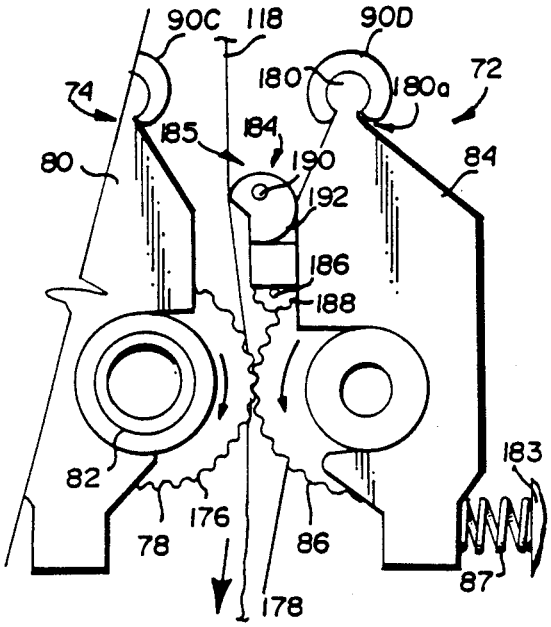
FIG. 9A
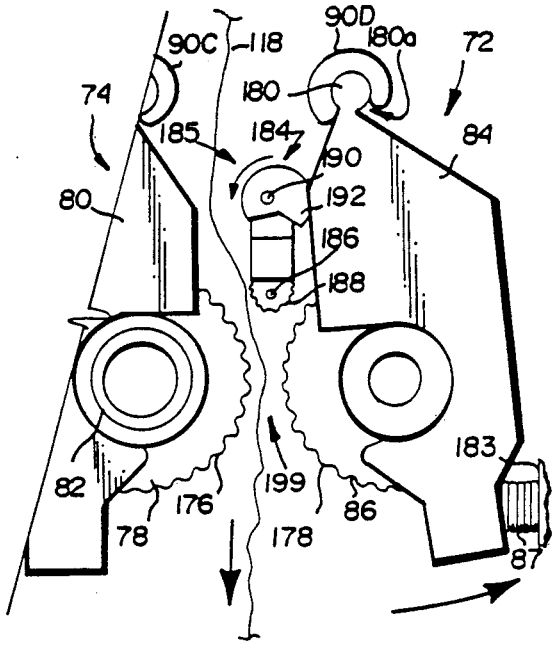
FIG. 9B
FIG. 10A
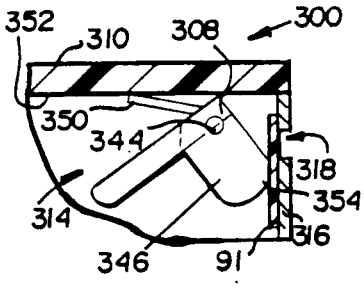
FIG. 10B
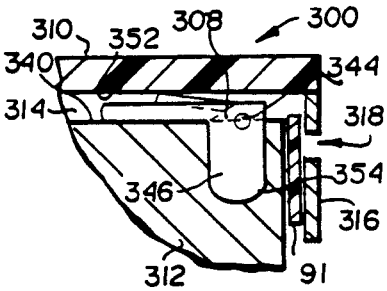
FIG. 11
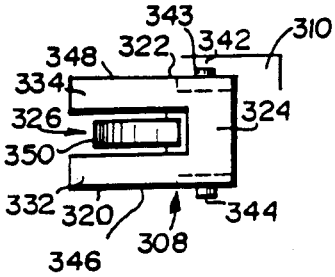
FIG. 12
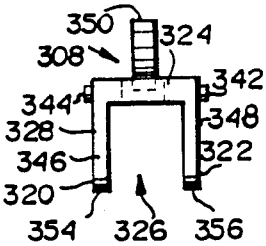
FIG. 13
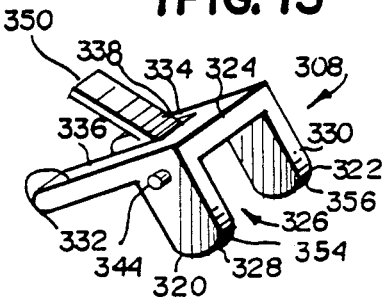

FIG. 14
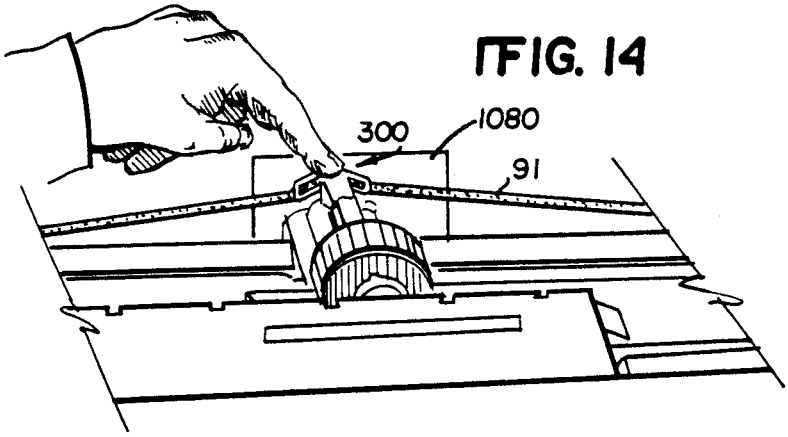
FIG. 15
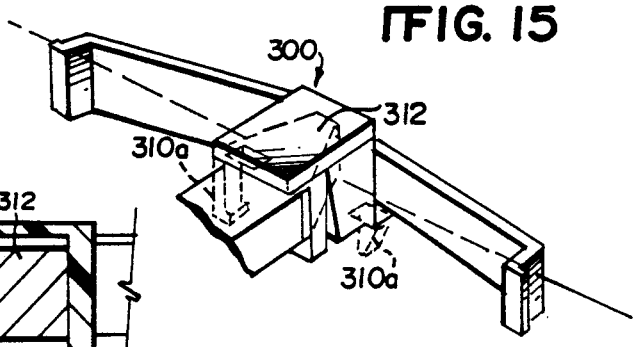
FIG. 15A
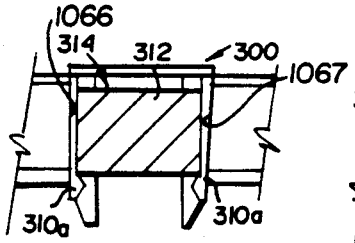
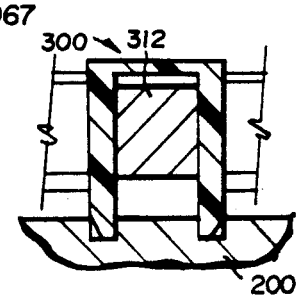
FIG. 15B
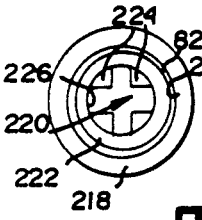
FIG.5F
FIG. 5B
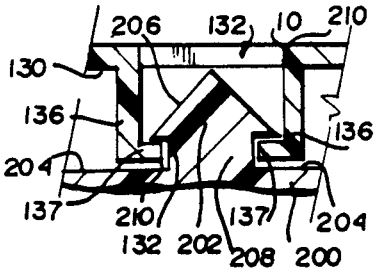
FIG.5E
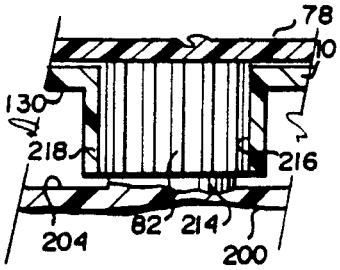
FIG.5D
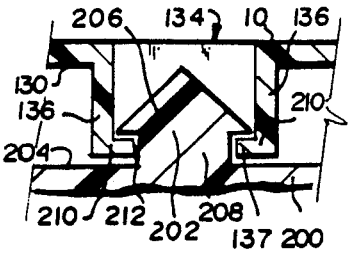
FIG.5C
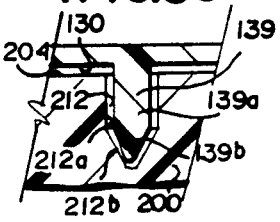
FIG.5G
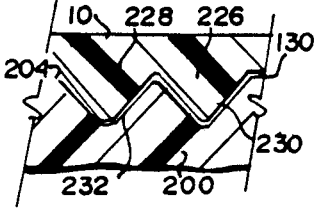
FIG.5H
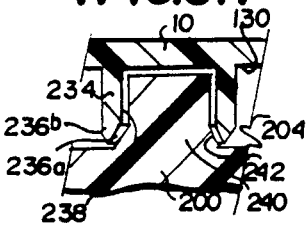
FIG.5I
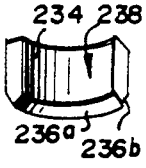

UNIVERSAL RIBBON CARTRIDGE FOR HIGH-SPEED PRINTERS

The present invention relates to print ribbon delivery systems for printers. More particularly, the present invention relates to replaceable ribbon cartridges containing a supply of print ribbon (e.g., a reusable fabric or a one-time-use carbon ribbon bearing a print vehicle such as pigments, dyes, etc.) for delivery to the print head of a high-speed printer.

Early high-speed printers and typewriters used separate ribbon spools mounted on different spindles to store unused inked ribbon, deliver ribbon to the printing mechanism, and take up used ribbon. Ribbon cartridges have now largely replaced the multiple-spool arrangements.

Because a ribbon cartridge contains most of the print ribbon (both used and unused) within the same enclosure, the possibility that the ribbon will contact undesirable objects (e.g., the clothing or skin of the person handling the cartridge, parts of the printing mechanism, or the print surface) is minimized. Moreover, ribbon replacement is simple with a ribbon cartridge—the old cartridge is simply disengaged from and lifted out of the printer and a new cartridge is installed in its place (a printer designed to use ribbon cartridges typically defines an open ribbon path so that the new ribbon supplied by the cartridge can be easily placed along the path).

Ribbon cartridges which deliver a supply of ribbon to a high-speed printer are generally known. The ribbon is drawn past the printhead, which may contain print elements (such as a matrix of print wires) which upon actuation are selectively driven into the ribbon, and a record medium (e.g., paper).

One exemplary ribbon cartridge is disclosed in commonly-assigned U.S. Pat. No. 3,989,132 to Carson, Jr. (1976) (the disclosure of which is incorporated herein by reference). Briefly, the ribbon cartridge disclosed in that patent includes a housing defining a so-called "stuff box" which stores most of a continuous loop of ribbon in a compact, folded mass. A portion of the ribbon loop extends outside the housing for engagement with the printhead of a printer. The cartridge includes a ribbon inverting mechanism disposed along the ribbon path which inverts the ribbon (thus forming a Mobius loop or strip in the ribbon and exposing a different side of the ribbon to the print medium each time the ribbon loop completes one full rotation). The ribbon inverting mechanism includes a succession of ribbon plane rotation guides.

The ribbon cartridge disclosed in the Carson, Jr. patent is successful in its own right. However, further improvements are possible.

While ribbon cartridges minimize the possibility that print ribbon will contact undesired objects, a length of ribbon must nevertheless extend outside of the ribbon cartridge housing so that the ribbon can be engaged with the printer printhead. If this length of ribbon is not protected in some way, it can smudge the print medium, get into the printer mechanism, and deposit ink onto the skin during removal and/or installation of the ribbon cartridge. Some ribbon cartridges (e.g., the cartridge disclosed in the Carson, Jr. patent; U.S. Pat. No. 4,413,920 to Matthias et al; and U.S. Pat. No. 4,486,107 to Willcox) include angled linear guides which extend from the cartridge and encase all but a portion of the ribbon which is actually to be disposed between the printhead and the print medium. Such ribbon guides increase the cost of the cartridge and make the cartridge more difficult to ship and store.

Another approach is to provide a smudge shield alternately engageable with the printer and with the ribbon cartridge outer casing. A portion of the ribbon extending from the cartridge is threaded through the smudge shield. During operation of the cartridge, the smudge shield retains the ribbon in position betWeen the printhead and the print medium, and also prevents the ribbon from rubbing against the print medium and smudging it. During storage and shipment of the ribbon cartridge, the smudge shield is removably mounted to the outer casing of the ribbon cartridge itself, thus helping to prevent the length of ribbon extending outside of the ribbon cartridge housing from contacting and/or becoming entangled with other objects.

Although this type of smudge shield has many advantages (e.g., is inexpensive and compact), it has some disadvantages as well. For example, ribbon may be pulled from the cartridge during storage, shipment or handling because the smudge shield does not prevent ribbon from translating through it when the smudge shield is mounted on the ribbon cartridge casing. A smudge shield of this type which could firmly retain the ribbon during storage, shipment, and handling of the cartridge and yet permit the ribbon to move freely during operation of the cartridge would be highly desirable and useful.

Ribbon cartridges which can be used with either reusable fabric ink ribbons or with non-reusable film ribbons are known (see, for example, U.S. Pat. No. 3,871,507 to Perry et al; U.S. Pat. No. 4,388,006 to Waibel; U.S. Pat. No. 3,863,749 to Perry et al). As those skilled in the art understand, a fabric or cloth ribbon impregnated with ink may be used over and over again until the ink finally dries out or has been transferred to the print medium—and it does not matter which side of the ribbon contacts the print medium. On the other hand, film-type carbon ribbons (which typically include an elongated sheet of thin plastic film coated on one side with a layer of carbon or other particulate inking material) are non-reusable and single-sided.

A carbon ribbon usually is not used after it has made a pass or two between the printhead and the print medium, since much of the carbon is transferred to the print medium during the printing process. Moreover, the carbon-coated surface of the film ribbon must always face the print medium if the print vehicle is to be transferred from it to the medium.

Because of these differences between carbon film-type ribbons and fabric ribbons, a cartridge designed to use both types of ribbons must handle the different ribbons in different ways. The fabric-type ribbon is desirably formed in a continuous loop and a ribbon inverter is placed along the ribbon path to permit the fabric ribbon to continuously rotate past the printhead while exposing alternate sides of the ribbon to the print medium on successive rotations. Because a carbon-film ribbon is non-reusable, there is no need for it to be in a continuous loop—after the carbon ribbon is used once, it can simply be drawn back into the cartridge for disposal. Moreover, a carbon-film ribbon need not be inverted, since only one side of such ribbon should be oriented towards the printed medium.

A "stuffer box" may be used to store fabric ribbon which has not yet been used (or is to be reused) or which already has been reused beyond its normal life. On the other hand, it is less expensive and more advantageous to store unused carbon-film ribbon on a spool, although a stuffer box may obviously be used to store the film ribbon which has already been used.

It would be highly desirable to provide an improved cartridge which can be easily adapted for controlling movement (including prevention of movement) of either a film or a fabric ribbon by simply installing a minimum of alternate parts. Such a cartridge design would substantially reduce manufacturing and inventory costs.

Various means for inverting a continuous ribbon loop to form a Mobius strip are known. The following non-exhaustive list of issued US patents disclose some such arrangements:

U.S. Pat. No. 4,383,774—Yonkers (1983)
U.S. Pat. No. 4,279,522—Yonkers (1981)
U.S. Pat. No. 4,293,234—Yonkers et al (1981)
U.S. Pat. No. 4,240,757—Hanna (1980)
U.S. Pat. No. 4,232,976—Bernardis et al (1980)
U.S. Pat. No. 4,227,820—Falcetti (1980)
U.S. Pat. No. 4,130,367—Guerrini et al (1978)
U.S. Pat. No. 4,051,944—Starr (1977)
U.S. Pat. No. 4,247,209—Carlson et al (1981)
U.S. Pat. No. 3,621,968—Kondur (1971)

None of these prior art ribbon inverting arrangements appear to provide a single alternate passage-defining structure which can be selectively used to invert or not invert a ribbon depending upon whether the ribbon being used is of the film or the fabric type. Such a selective ribbon inverting arrangement would be highly advantageous, and useful in enabling a single compact ribbon cartridge to be readily adapted for use with either type of ribbon.

Although a full useful life for the ribbon cartridge is highly desirable, users sometimes attempt to use a cartridge beyond its normal life expectancy. This can cause unwarranted perceptions of poor ribbon quality—and become the source of adverse service calls, poor customer relations and the like. Accordingly, it would also be desirable to automatically meter cartridge usage and to automatically prevent substantial overuse of the cartridge. Also desirable is an arrangement which allows cartridges to be easily engaged with and disengaged from the printer mechanism, and which also holds cartridges firmly in position during cartridge operation.

SUMMARY OF THE INVENTION

The present invention relates to a ribbon cartridge having many advantageous features and improvements over the prior art.

In brief summary, this invention provides an improved ribbon cartridge construction and process applicable to controlling the movement (including prevention of movement) of either extensive reusable or limited reusable print ribbon which offers the following features:

1. A smudge guard/ribbon guide which retains exposed ribbon in a fixed stationary position during cartridge transportation and storage—but which structure then attaches to a printhead, releases ribbon passage therethrough and acts as a smudge guard/ribbon guide during normal cartridge usage;
2. A Mobius loop forming structure (along a first path for fabric ribbons) which includes a central aperture therethrough so as to alternately permit direct non-inverting ribbon passage through the same structure (along a second path, which intersects the first path, for carbon film-type ribbons);
3. A limited usage metering and self-stopping mechanism which insures against over-extended usage of the cartridge; and
4. A keying arrangement which firmly retains the cartridge in the printer during operation and also permits easy, non-destructive removal and installation of cartridges, and prevents improper cartridges from being installed.

In accordance with the present invention, exposed ribbon is thus retained in a fixed stationary position during cartridge transportation and storage, and is moved past a printhead during normal cartridge usage. The ribbon is alternately moved along a first path internal to a ribbon cartridge while being inverted, and is moved along a second path also internal to the cartridge without being inverted. Ribbon usage is metered inside the cartridge, a predetermined ribbon usage is detected, and further passage of ribbon through the cartridge is prevented in response to such detection. Engagement of a proper cartridge to a printer support is enabled (while preventing engagement of an improper cartridge) by mating multiple point cross sectional engaging surfaces of a male key with a female key receiving component respectively carried by a proper cartridge and a printer support.

In accordance with one such feature of the present invention, a ribbon guide is provided which prevents print ribbon from moving when the ribbon cartridge is being stored, shipped or handled, and yet allows the ribbon to move freely when the cartridge is installed in a printing device and the ribbon guide is engaged with the printer. Additionally, the guide is designed to simply and removably mount to a printhead for guiding a translating ribbon along a path past print elements of the printhead.

The guide provides a surface disposed along the path. The guide also includes a ribbon locking structure where in a first position, the member retains the ribbon in a stationary position against the surface, and in a second position the member permits the ribbon freely to translate along the path. The member automatically moves to the first position when the structure is disengaged from the printhead, and moves to the second position when the structure is mounted to the printhead.

In accordance with another feature of the invention, the print ribbon cartridge includes a housing having inlet and outlet ports. The portion of a ribbon disposed within the housing exits the housing through the outlet port and enters the housing through the inlet port. Means disposed within the housing exhausts ribbon from the housing through the outlet port and draws ribbon from the inlet port into the housing, and provides alternate paths for ribbon movement and function with the cartridge.

A ribbon guide disposed within the housing between the ribbon supplying/drawing means and the inlet and outlet ports defines first and second alternate, intersecting ribbon paths. The orientation ribbon disposed along the first path is axially rotated approximately 180° at its terminus relative to the ribbon orientation at its origin. The orientation of ribbon disposed on the second path is not axially rotated at the terminus relative to the ribbon orientation at the origin.

A first ribbon rotating substructure may axially rotate the ribbon by approximately 90° in a first rotational direction. A second ribbon rotating substructure, also disposed along the first path, may further actually rotate the ribbon by approximately 90° in the same direction. A gap is defined between the first and second ribbon rotating substructures. A selecting device directs the ribbon to translate alternately: (a) through the two substructures; or (b) through the gap between the two substructures.

In accordance with a further—of the invention, a ribbon cartridge is provided with a device for metering the amount of ribbon discharged from the housing. A motion preventing device responsive to the metering device prevents further ribbon from being discharged once the amount of metered ribbon exceeds a predetermined limit.

The metering device may include a counter coupled to a pinch wheel and/or a drive wheel, the pinch and drive wheels cooperating to draw ribbon into the cartridge housing and/or emit ribbon from the cartridge housing. The pinch wheel may be pivotal between a first position whereat the pinch and drive wheels contact the ribbon therebetween, and a second position whereat the drive and pinch wheels are spaced apart from one another. A counter counts the rotations of the wheel it is coupled to and pivots the pinch wheel to the second position when the counted number exceeds a predetermined number. A biasing device may be disposed between the pinch wheel and the housing for biasing the pinch wheel to the first position.

In accordance with yet another feature of the invention, an arrangement is provided for facilitating mounting of a printer ribbon cartridge on a printer platform so as to permit mounting of only properly mating cartridges. The cartridge is provided with a drive device located adjacent one end of the cartridge for engaging an external ribbon drive carried by the printer. A pair of spaced-apart snap clips are located adjacent opposite ends of the cartridge, oriented at an angle relative to one another and extend from the cartridge. The clips mate with corresponding locking elements contained on the platform. A non-circularly symmetric post extending from the cartridge other end mates with a corresponding non-circularly symmetric receiver on the platform. The drive device mates with the ribbon drive and the post mates with its corresponding receiver before the snap clips are engaged with their corresponding locking elements.

The present invention thus provides many advantages over prior art ribbon cartridges. The ribbon cartridge of the present invention can be used with either fabric or film ribbons, and inverts fabric ribbons but not film ribbons. A ribbon guide is provided which holds the ribbon in a stationary position when the cartridge is being stored, and permits the ribbon to move freely when the cartridge is in use. A metering device automatically prevents further continuous ribbon from being dispensed after a predetermined length of ribbon has already been dispensed. An arrangement facilitating mounting of the cartridge on the printer permits easy engagement and disengagement of a correctly mated cartridge with the printer and firmly retains the cartridge in position during printer operation.

BRIEF DESCRIPTION OF THE DRAWINGS

These and other features and advantages of the present invention will be better and more completely understood by referring to the following detailed description of preferred embodiments together with the accompanying sheets of drawings of which:

FIGS. 5B–5I are cross-sectional side views of various keying locking structures of the FIG. 5 cartridge;

FIGS. 9A and 9B show the drive mechanism of the ribbon cartridge shown in FIG. 1, the drive mechanism including a retrieving device which disables further dispensing of ribbon once a predetermined length of ribbon has passed therethrough;

FIG. 10A is a side view in cross-section of the ribbon guide shown in FIG. 3 in a storage position;

FIG. 10B is a side view in cross-section of the ribbon guide shown in FIG. 3 while in an operating position and engaged with the printhead of a printer;

FIGS. 11–13 are different views of the pivoting member portion of the ribbon guide shown in FIGS. 3, 10A and 10B;

FIG. 14 is a side perspective view of the ribbon guide shown in FIG. 3 being engaged with the printhead of a printer;

FIG. 15 is a detailed side perspective view of the ribbon guide shown in FIG. 3 as engaged with a printhead; and FIGS. 15A and 15B are side views in cross-section of the ribbon guide shown in FIG. 3 as engaged with a printhead.

DETAILED DESCRIPTION OF PREFERRED EMBODIMENTS

Figure 1:
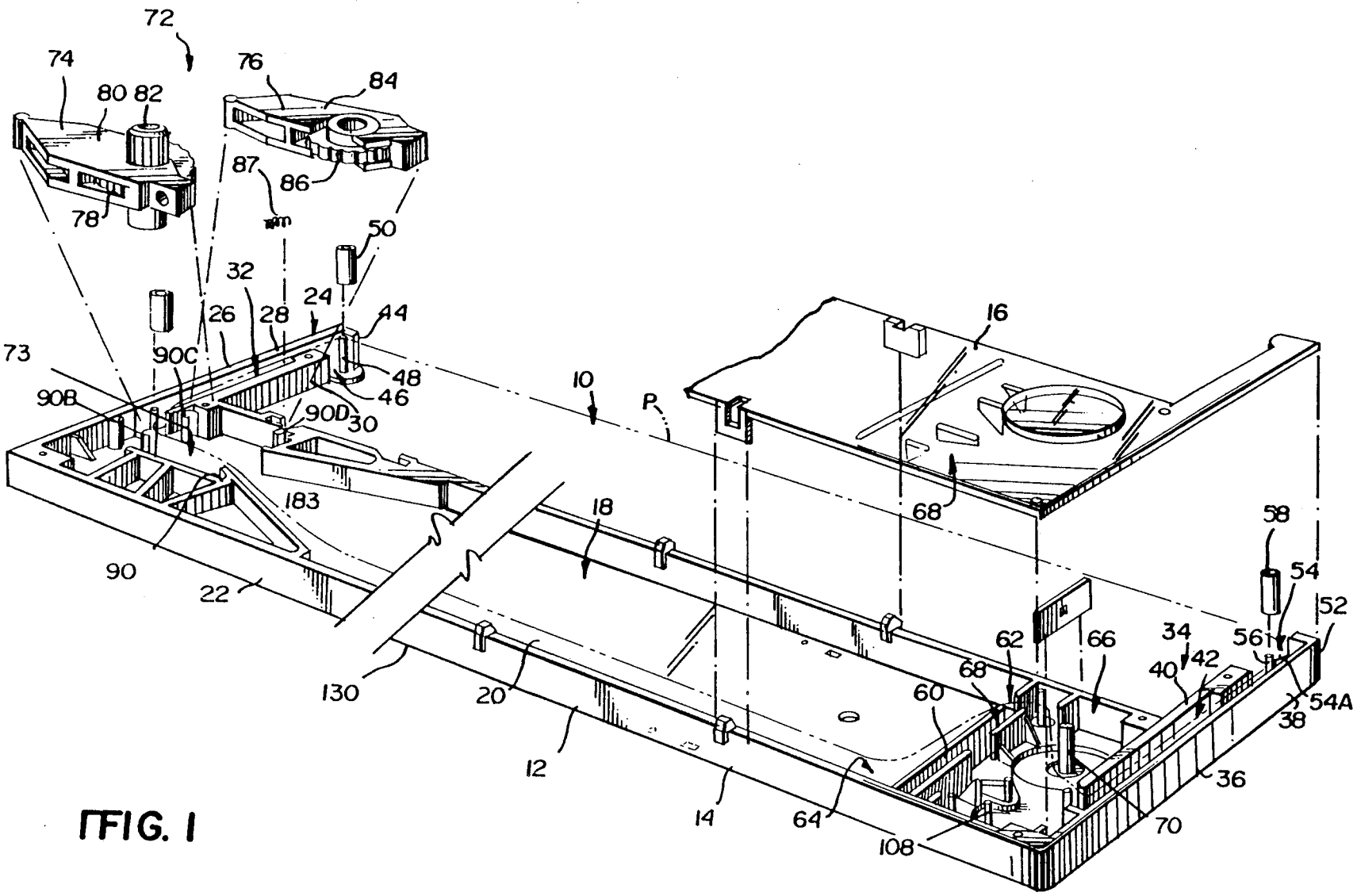
FIG. 1 is an elevated exploded view in perspective of the ribbon cartridge housing of the preferred embodiment of the present invention.

FIG. 1 is an elevated perspective view of housing 12 of the presently preferred exemplary embodiment of a ribbon cartridge 10 in accordance with the present invention. Cartridge 10 in adaptable for use with either reusable print ribbon (e g., cloth or fabric ink-impregnated ribbons) or non-reusable ribbon (e.g., carbon film type ribbon). Different components are assembled into housing 12 to adapt cartridge 10 for the type of ribbon to be used.

Housing 12 includes a lower portion 14 and an upper portion 16 connectable together to form an enclosed inner space 18. Housing lower and upper portions 14, 16 are preferably each molded from impact resistant plastic using a conventional molding process. Lower portion 14 includes a substantially flat sheet 20 the edges of which terminate in a side wall 22 which projects perpendicularly upward from and surrounds the edges 20A of the sheet 20.

A ribbon inlet arm 24 formed at an end 26 of housing lower portion 14 includes an outer wall 28 and an inner wall 30 defining a channel 32 therebetween. Similarly, a ribbon outlet arm 34 disposed at a lower housing portion further end 36 includes an outer wall 38 and an inner wall 40 defining a channel 42 therebetween. Ribbon inlet arm 24 terminates at an end 44 defining an inlet slot 46 in communication with channel 32. A post 48 molded into inlet arm 24 supports a rotatable roller wheel 50. In similar fashion, an end 52 of ribbon outlet arm 34 terminates in an outlet slot 54, and a post 56 projecting from the outlet arm 34 in or near the slot opening 54A supports a rotatable roller wheel 58.

Various structures are molded into housing lower and upper portions 14, 16. For example, a ribbon dam 60 is molded into housing lower portion 14, this dam 60 separating the space 18 defined within the housing lower portion near end 36 into a ribbon storage space 64 and a ribbon delivery space 66. A slot 62 defined in dam 60 permits ribbon to pass from space 64 into space 66. Ribbon storage space 64 stores a quantity of ribbon to be delivered to an external printing station (not shown), either on a spool or in the folded mass, as will be explained shortly.

Ribbon delivery space 66 contains various structures which prepare ribbon exiting storage space 64 through slot 62 for delivery to the external print station via ribbon outlet arm outlet slot 54. For example, a ribbon inverting structure 68 (to be described in much greater detail in connection with FIGS. 6–8B) selectively inverts print ribbon to form a Mobius loop, or does not invert it, depending upon the type of ribbon cartridge 10 is loaded with. A post 70 disposed within ribbon delivery space 66 and extending perpendicularly upwards from housing lower portion 14 may rotatable support an idler pulley to be described in greater detail in connection with FIGS. 2–3B. Various pins, holes and slots molded into housing lower portion 14 within ribbon delivery space 66 facilitate ribbon travel, ribbon inversion and/or proper tensioning of ribbon between slot 62 and outlet slot 54.

A ribbon drawing (driving) device 72 is disposed in a ribbon driving space 73 within housing 12 near end 26, this ribbon drawing device 72 including a main drive gear structure 74 and a pinch wheel structure 76. Main drive gear structure 74 includes a main drive gear 78 rotatably disposed within a drive housing 80 and connected to a drive spindle 82 adapted to be driven by a rotating member external to cartridge 10 (as will be explained shortly in greater detail). Pinch wheel structure 76 includes a pinch wheel housing 84 rotatably supporting a pinch wheel 86 therein. Holes defined in housing lower portion 14 and housing upper portion 16 permit an external drive shaft or other structure to be coupled to drive spindle 82.

Supporting structures 90 retain main drive gear structure 74 and pinch wheel structure 76 in positions relative to one another (as will be explained in greater detail in connection with FIGS. 9A and 9B) such that drive gear 78 and pinch wheel 86 contact one another about their respective peripheries. A compression spring 87 disposed between pinch wheel structure 84 and housing wall 22 biases pinch wheel 86 towards drive gear 78.

A length of print ribbon is stored within ribbon storage space 64, delivered to a printing station external to cartridge 10 by components disposed within ribbon delivery space 66 (the ribbon exiting cartridge 10 via outlet slot 54), drawn back into the cartridge 10 by main drive gear and pinch wheel structures 74, 76 (the ribbon reentering the cartridge 10 via inlet slot 46), and is once again stored within the ribbon storage space. Thus, a ribbon path P originates in a ribbon storage space 64, passes out of cartridge 10 (through ribbon delivery space 66 and outlet slot 54), passes through an external print station (ordinarily, between a printer printhead and a medium to be printed), reenters the ribbon cartridge 10 (via inlet slot 46 and ribbon driving space 73), and finally, terminates within the ribbon storage space 64.

Figure 2:
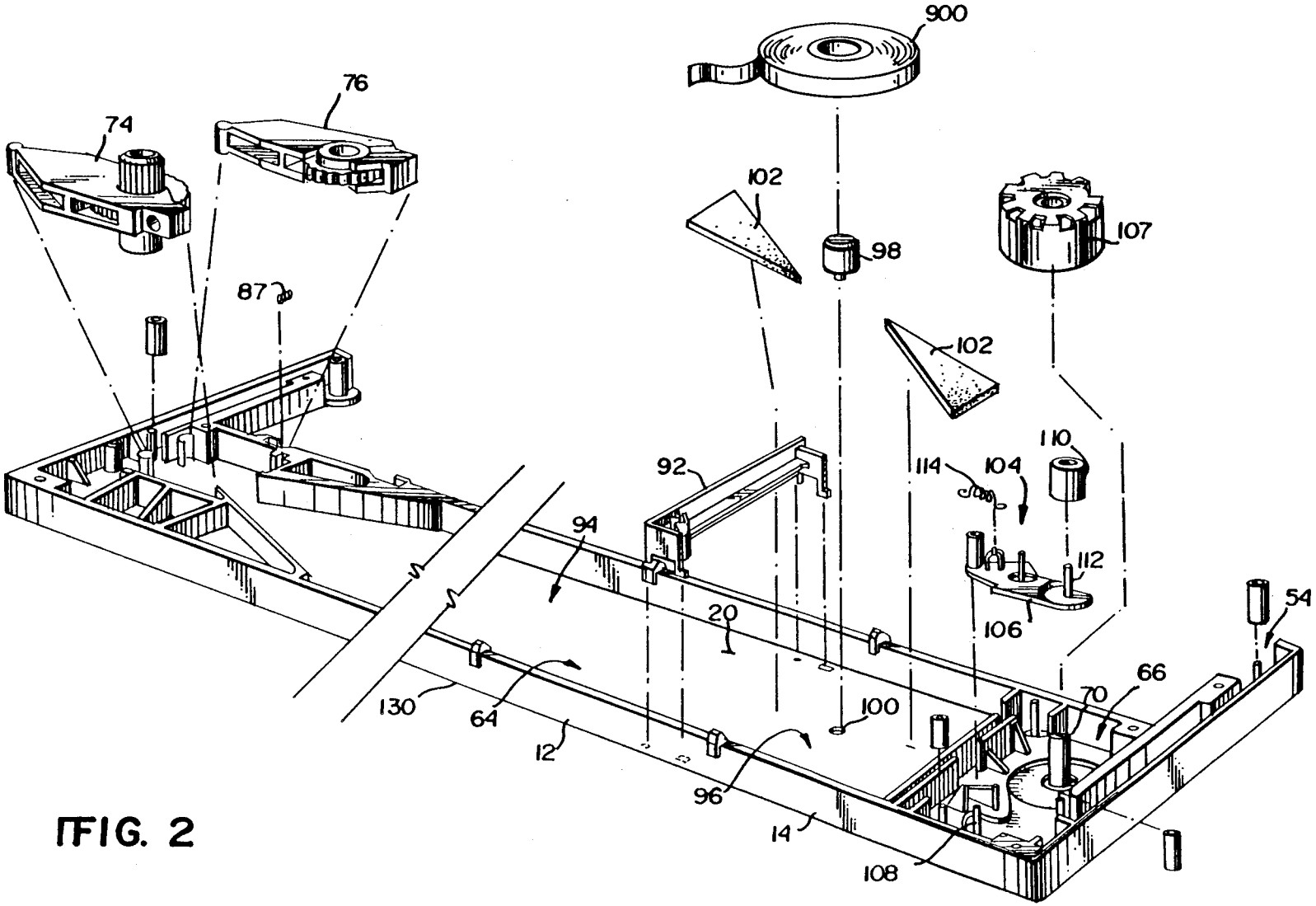
FIG. 2 is an elevated exploded view in perspective of the cartridge housing shown in FIG. 1 adapted for dispensing a non-reusable ribbon.
Figure 3:
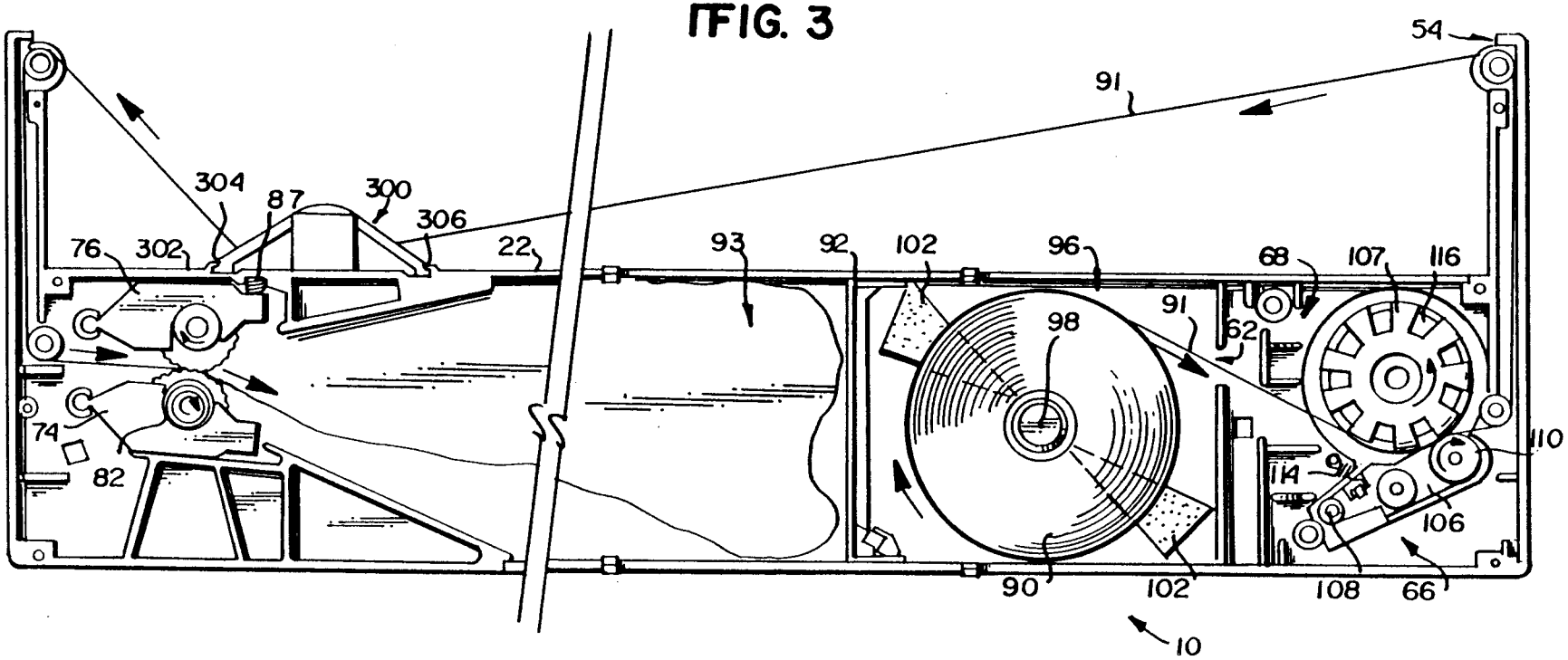
FIG. 3 is a top view in plan of the assembled ribbon cartridge of the preferred embodiment adapted for dispensing a non-reusable (limited use) ribbon.

FIG. 2 is an exploded view of the components which are installed in housing 12 to adapt the housing 12 for use with a non-reusable ribbon (not shown), and FIG. 3 is a top view in plan of cartridge 10 after such components have been installed. In the preferred embodiment, non-reusable ribbon 91 which has not yet been used is stored on a spool 900, and the ribbon 91 after being used is stored in a folded mass 93. A removable dam structure 92 is disposed in cartridge 10 to divide ribbon storage space 64 into two parts: a "stuffer box" 94 (which stores the folded ribbon mass 93); and a spooling space 96. A post 98 is mounted in a hole 100 defined in lower housing portion 14 within spooling space 96, spool 900 being rotatably mounted on the post 98. Foam inserts 102A are disposed between spool 900 and lower portion flat sheet 20 to hold ribbon 91 during shipment and provide some tension to prevent the ribbon 91 from unspooling (spring tension might fracture the ribbon 91).

Figure 3B:
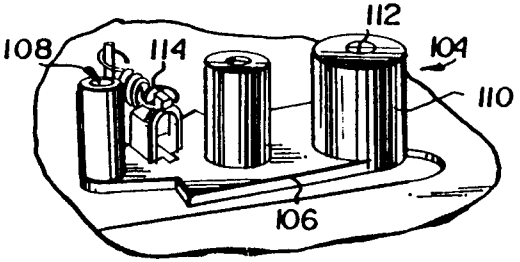
FIG. 3B is an elevated side view in perspective of the ribbon tensioning assembly shown in FIGS. 2 and 3.

A tensioning assembly 104 mounted in ribbon delivery space 66 provides proper tension for the non-reusable ribbon 91 exiting outlet slot 54. FIG. 3B shows tensioning assembly 104 in detail. Tensioning assembly 104 cooperates with a rotatable pulley wheel 107 rotatably mounted to post 70 to provide correct ribbon tension.

Tensioning assembly 104 includes a plastic plate 106 pivotably mounted on a post 108. An idler 110 rotatably mounted on a post 112 projecting from plate 106 rotates in contact with pulley heel 107. A spring 114 biases idler wheel 110 toward pulley wheel 107 such that ribbon 91 is retained and held between the pulley and idler wheels 107, 110. As ribbon is pulled from outlet slot 54, pressure exerted by idler wheel 110 onto ribbon 91 under the force of biasing spring 114 causes both pulley wheel 107 and the idler wheel 110 to rotate in contact with the ribbon 91.

Figure 3A:
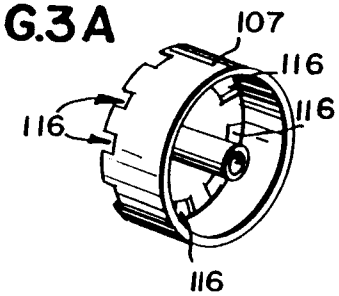
FIG. 3A is an elevated side view in perspective of the optical encoder guide wheel shown in FIGS. 2 and 3.

Pulley wheel 107 defines a plurality of apertures 116 which are preferably evenly spaced apart around the circumference of the wheel (see FIG. 3A). Rotation of pulley wheel 107 can be optically sensed externally to cartridge 10 by shining a beam of light toward the pulley wheel through one of upper and lower housing portions 14, 16 (housing 12 is preferably made of light-transmissive plastic for this reason) and detecting modulations in the light passing through (or reflected by) the housing. If drive force is applied to main drive gear spindle 82 and pulley wheel 107 does not rotate, ribbon breakage or jamming has probably occurred and corrective should be taken.

If desired, the number of time pulley wheel 107 obstructs a narrow beam of light then permits the beam to pass therethrough (i.e., the number of light pulses which pass through the rotating pulley wheel 107) can be counted (using, for example, a conventional photocell the output of which is amplified, buffered and applied to a digital logic counter input) and used to determine the length of ribbon 91 which was passed through ribbon delivery space 66.

Figure 4:
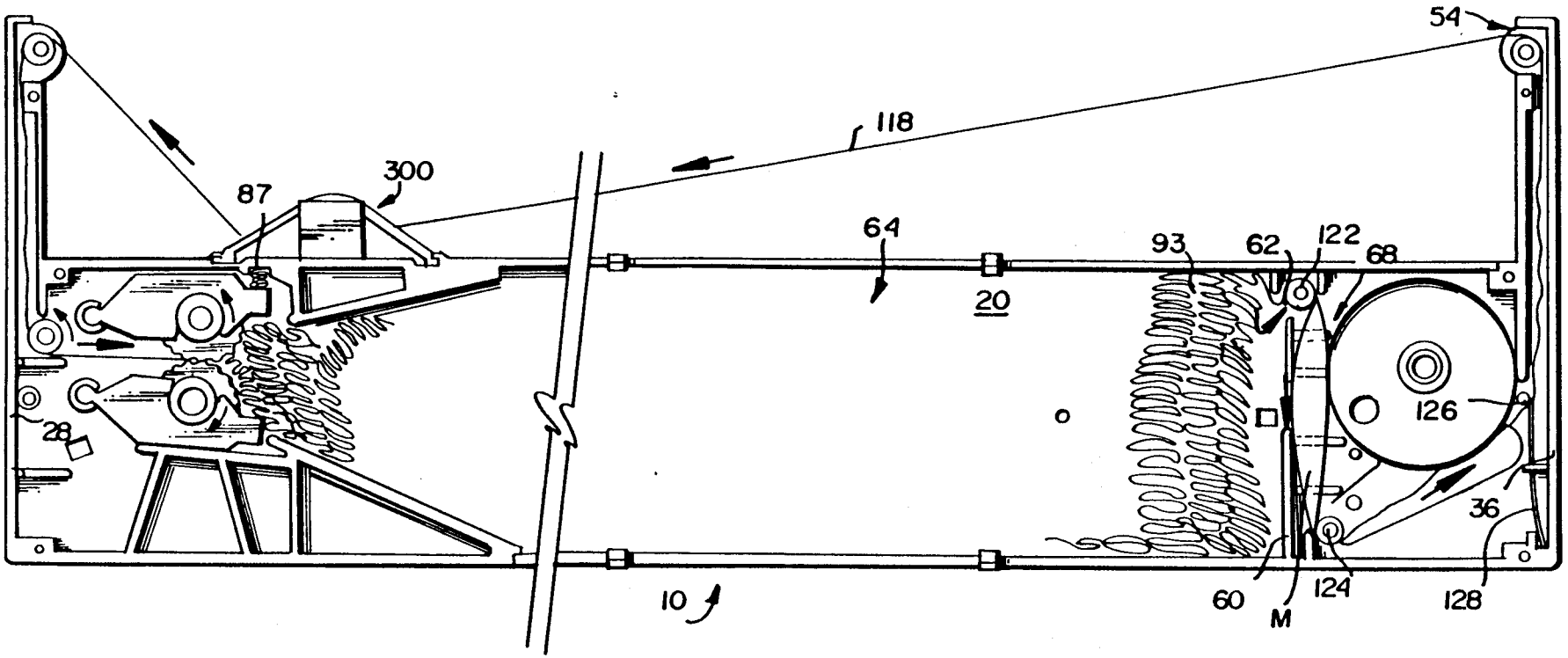
FIG. 4 is a top view in plan of the ribbon cartridge of the preferred embodiment adapted for dispensing a reusable ribbon.

FIG. 4 is a top view in plan of ribbon cartridge 10 as adapted for dispensing and storing a continuous loop of reusable ribbon 118 (e.g., fabric or cloth ribbon). In the reusable ribbon adaptation, the entire ribbon storage space 64 is used as a so called "stuffer box" to store most of ribbon 118 in a folded mass 93 (for this reason, cartridge side walls 22, 28, 36 have a uniform height substantially equal to the width of ribbon 118 to cause the ribbon 118 within the ribbon storage space 64 to support its an upright position approximately parallel to the side walls 22, 28). Ribbon 118 is forced into storage space 64 (by main drive gear and pinch wheel structures 74, 76) at the end of the storage space in proximity to cartridge end 26, and is drawn from the storage space through slot 62 defined in dam 60. Ribbon 118 exiting storage space 64 through slot 62 passes around a roller 122, and is rotated 180° to form a Mobius loop M by a ribbon inverting structure 68. The inverted ribbon passes around a roller 124 and then around a post 126 before exiting cartridge 10 via outlet slot 54. A spring 128 (preferably a flexible piece of eight mil metal cut to appropriate dimensions) presses ribbon 118 into firm contact with post 126, thus tensioning the ribbon 118, preventing ribbon 118 from being drawn too rapidly from outlet slot 54, and helping to straighten out folds in the ribbon 118.

Figure 5:
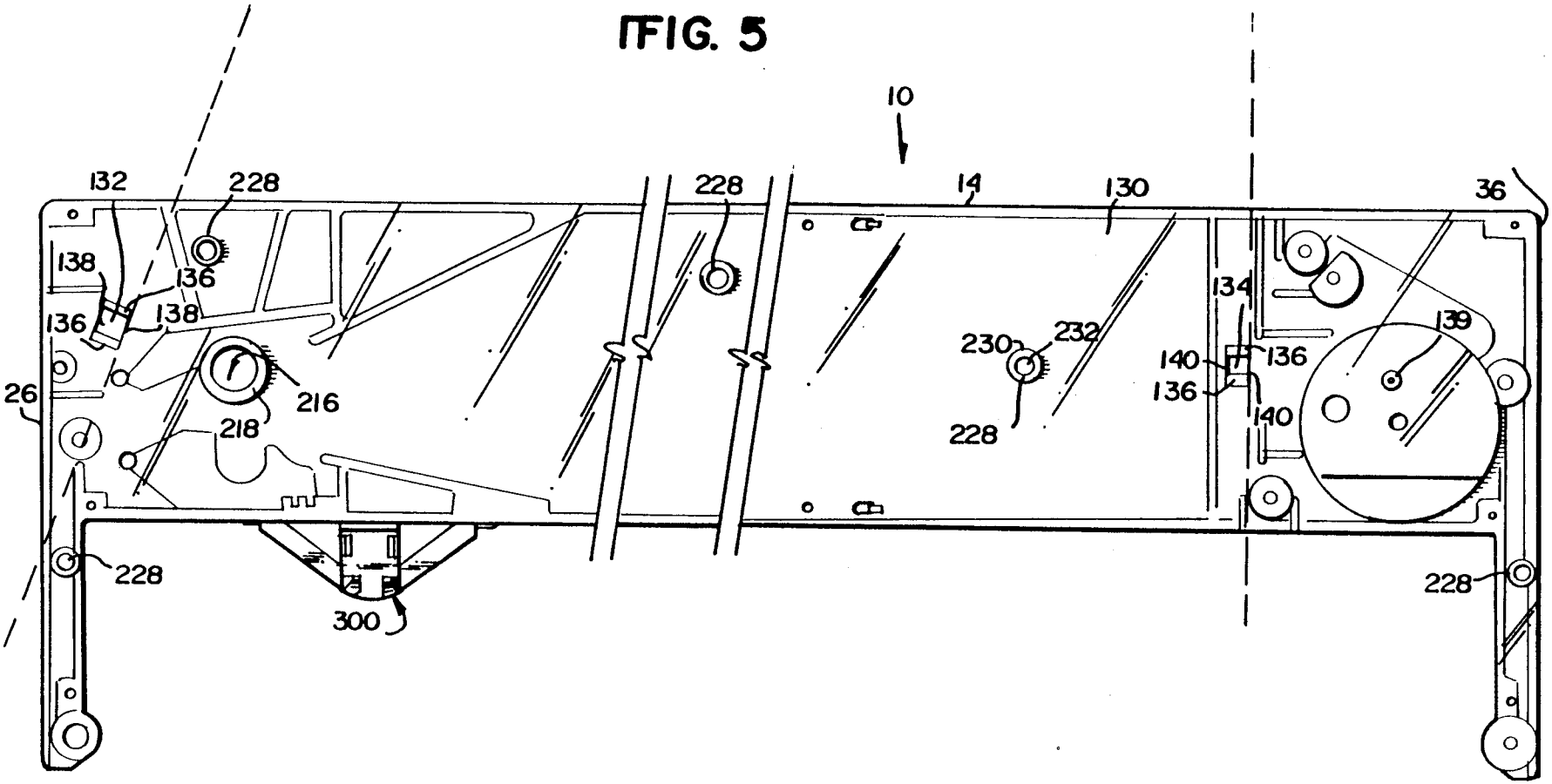
FIG. 5 is a bottom view in plan of the ribbon cartridge housing shown in FIG. 1 showing the keying-/locking arrangement of the present invention.

FIG. 5 is a bottom view in plan of housing lower portion 14. Keying clips or other structures extending from the housing lower portion bottom surface 130 permit cartridge 10 to be positively snapped into position with respect to and firmly retained by a printer cartridge mounting platform MP disposed within the printing device.

In one embodiment, such keying structures include spaced-apart slots 132, 134 formed at opposite housing ends 26, 36 and projecting fingers 136 projecting upwards (in the view shown in FIG. 5) from either side of each slot 132, 134. Fingers 136 terminate in inwardly-directed portions 137 which oppose one another (as can best be seen in FIGS. 5B and 5D). Slots 132, 134 and Fingers 136 together form snap clips for mating with corresponding locking elements (to be explained shortly) on a printer platform MP. Slots 132 and 134 are substantially rectangular and have parallel edges 138 and 140, The orientation of parallel edges 138 of slot 132 is offset by an angle (approximately 15°-25° in the preferred embodiment) in respect of orientation of edges 140 of slot 134.

FIGS. 5B and 5D show respectively how projecting fingers 136 mate with structure provided on a printer mounting platform 200 disposed within a printer to provide a snap fastening action. A projection 202 extending from upper printer platform surface 204 includes a conical head 206 supported on a stem 208. Head 206 has a lower dimension in cross-section which is slightly larger than the gap between opposing projecting finger inwardly-directed portions 137 but which is slightly smaller than the dimension of slot 132 (134). Projecting fingers 136 are relatively rigid, but can be flexed so as to increase the length of the gap between inwardly-directed portions 137 to become greater than the dimensions of slots 132, 134. Indentations 210 defined by stem 208 between head 206 and upper platform surface have sizes and spacings which are adapted to receive inwardly-directed portions 137.

To engage projecting fingers 136 with corresponding locking projections or elements 202, the gap between finger inwardly-directed portions 137 is aligned with head 206, and cartridge 10 is simply pressed downwards towards platform 200 to cause projecting fingers 136 to flex outward as they slide down on opposite surfaces of the conical head 206—permitting the head 206 to snap or slide into and become retained within the space between the fingers 136. Finger inwardly-directed portions 137 slide into indentations 210 to engage cartridge 10 with platform 200.

Cartridge 10 is disengaged from platform 200 by simply lifting the cartridge 10 away from the platform—causing projecting fingers 136 to flex outward (away from one another) to leave a gap therebetween exceeds the largest cross-sectional dimension of locking projection or member 202.

Although locking projections or member 202 has been described as structure projecting from surface, it will be recognized that an alternate locking element including spaced-apart notches or grooves defined through surface might be used instead. Such notches should be in registry with projecting fingers 136, and have widths which are greater than the cross-sectional width of the projecting fingers 136 but smaller than the cross-sectional dimension of inwardly-directed portions 137. Such alternate locking elements might be used if it is desirable to have cartridge lower surface 130 rest in direct contact with platform upper surface 204.

Figure 5A:
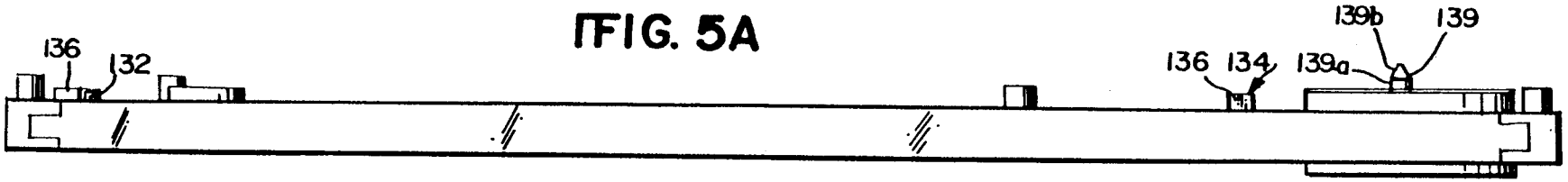
FIG. 5A is a side view in plan of the ribbon cartridge housing shown in FIG. 5 with the bottom surface of the cartridge facing upwards.

Referring now more particularly to FIGS. 5, 5A and 5C, a tapered post 139 projects from bottom cartridge surface 130 beneath the portion of ribbon delivery space 66 housing pulley wheel 107. Post 139 includes a cylindrical portion 139*a* which terminates in a conical portion 139*b*. Post 139 mates with a corresponding receiver 212 defined in platform upper surface 204, the receiver 212 having an upper, cylindrical portion 212*a* and a lower (concave) conical portion 212*b*. Thus, post 139 is a mating male portion projecting from cartridge 10 which mates with female receptacle or receiver (recess) 212 defined within the platform surface. Post 139 is simply inserted axially into receptacle 212 to mate the post 139 with the receptacle and thus key cartridge 10 with platform 200.

A further mating connection between cartridge 10 and printer platform 200 is formed by engaging on external ribbon drive cylinder 214 with drive spindle 82 projecting from cartridge lower surface 130 (as can best be seen in FIG. 5E). As mentioned previously, drive spindle 82 (which is integral with drive gear 78 in the preferred embodiment) is adapted to be rotated by an external drive shaft, the external shaft being connected to a source of rotational energy (e.g., a motor or the like).

In the preferred embodiment, spindle 82 is cylindrical and is rotatably disposed in the center of a cylindrical hole 216 defined within a hollow, cylindrical open-ended projection 218 extending from cartridge bottom surface 130. In the preferred embodiment, the outside diameter of drive spindle 82 is only slightly less than the inside diameter of cylindrical hole 216, causing drive gear 78 to be retained in a proper alignment while permitting the drive spindle 82 to rotate freely within the hole 216.

Spindle 82 is itself hollow, and defines a cylindrical cavity 220 within it terminating in an inward bevel 222 (as can best be seen in FIG. 5F). Projections 224 projecting from inner cylindrical wall 226 define a "cross"-shaped female engaging portion adapted to accept cylinder or shaft 214 (which in the preferred embodiment has a mating male engaging portion shaped as a "cross" in cross section). Projection 224 prevents drive shaft 214 from slipping with respect to spindle 82 as the shaft 214 drives the spindle 82 to rotate.

Several additional hollow cylindrical structures 228 extend from cartridge bottom surface 130 in the preferred embodiment. These additional structures act as spacers to space cartridge bottom surface 130 above platform upper surface 204. Each of structures 228 in the preferred embodiment includes an outer projecting cylindrical portion 230 defining an inner cylindrical hollow 232 axially therein.

To mount cartridge 10 onto platform 200, drive shaft 214 is first inserted into circular hole 216 and mated with drive spindle 82 while the cartridge 10 is held at an angle with respect to platform 200. Cartridge 10 is then aligned by moving it until post 139 is aligned with corresponding recess 212 defined in printer platform surface 204. Post 139, and corresponding recess 212 facilitate alignment of snap action fingers 136 and locking member 202 and prevent damage to or breakage of these components. Post 139 and recess 212 also constitute a keying structure which prevents the insertion of an improper cartridge (e.g., when they have non-mated symmetric cross-sections). In a preferred embodiment, keying post 139 is located on the opposite side of the cartridge 10 from and in substantial alignment with elements 214 and 216.

When cartridge has been properly aligned, it is pushed down until projecting fingers 136 snap and engage with projections or structure 202 provided on platform 200. Attempts to force fingers 136 onto projections or structure 202 when the fingers are misaligned with elements 202 damage the fingers 136—thereby defeating their intended function.

FIGS. 5G–5I show some alternate multi-point, as for example, non-circularly symmetric keying structures which might be used as the keying structures shown in FIGS. 5–5F. The keying structure shown in FIG. 5G includes double, adjacent conical projections 226, 228 which mate with corresponding adjacent conical depressions 230, 232. In an alternate arrangement, each of conical projections 226, 228 is shaped like post 139 (i.e., having a cylindrical position terminating in a conical portion) and depressions 230, 232 define a common, ellipsoid-shaped upper depression and spaced-apart concave conical depressions at the bottom of the ellipsoid-shaped depression.

FIG. 5H shows a further locking structure including an arc-shaped (crescent) cylindrical projection 234 terminating in double beveled edges **236*a*, 236*b* and defining a cylindrical opening 238 therein. Projection 234 mates with an arc-shaped cylindrical projection 240 projecting from upper platform surface 204. A beveled portion 242 defined on projection 240 at the point at of which the projection 240 meets the surface 204 contacts beveled portion 236*a***.

Ribbon inverting structure 68, as mentioned previously, selectively, alternately inverts or not inverts ribbon passing through it depends upon whether the ribbon is of a reusable or non-reusable type. The structure and operation of ribbon inverting structure 68 will now be discussed in greater detail in connection with FIGS. 6–8B.

Figure 6:
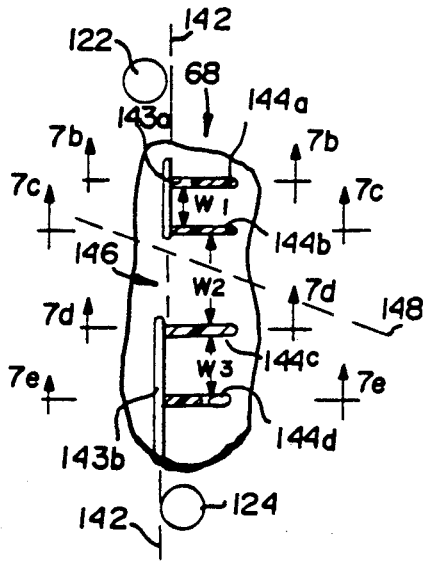
FIG. 6 is a top view in cross-section of the ribbon inverter of the present invention.

FIG. 6 is a top view in cross section of ribbon inverting structure 68. Ribbon inverting structure 68 includes a linear wall segment **143*a* and a further linear wall segment 143*b*, both extending upwards out at the plane of FIG. 6. Four substructures 144*a*, 144*b*, 144*c* and 144*d* extend perpendicularly to a common axis 146 disposed along linear wall segments 143*a*, 143*b*. Substructures 144*a* and 144*b* (which together comprise a first ribbon rotating means) are connected to and extend from wall segment 143*a*, and substructures 144*c* and 144*d* (which together comprise a second ribbon rotating means) are connected to and extend from linear wall segment 143*b*. Substructures 144*a*–144*d* each, in the preferred embodiment, include structure integral to housing upper portion 16 and structure integral to housing lower portion 14**.

Substructures **144*a*–144*d* are spaced apart from one another along axis 142 by predetermined spacings in the preferred embodiment. A gap 146 between substructures 144*b* and 144*c* defines a ribbon path 148 (intersecting axis 142**) over which ribbon may travel without being inverted.

In general, the spacing between substructures **144*a* and 144*d* should be as small as possible (so that the ribbon inverting structure 68 can be as compact as possible) consistent with: (1) the requirement that gap 146 must be large enough to permit ribbon to pass freely therethrough, and (2) the additional requirement that sufficient spacing must be provided between adjacent ones of substructures 144*a*–144*d*** to prevent the ribbon from folding up onto itself.

In the preferred embodiment, the distance between substructure **144*a* and substructure 144*d* is approximately 1½ inches; the spacing between the center of substructure 144*a* and the center of substructure 144*b* (dimension $W_1$ shown in FIG. 6) is approximately ⅜ of an inch; the spacing between the center of substructure 144*b* and the center of substructure 144*c* (dimension $W_2$ shown in FIG. 6) is approximately ⅝ of an inch; and the spacing between the center of substructure 144*c* and the center of substructure 144*d* (dimension $W_3$ shown in FIG. 6**) is approximately 7/16 of an inch.

Each of substructures **144*a*–144*d* includes two opposing, parallel planar surfaces defining a gap therebetween. The preferred embodiment ribbon inverting structure 68 rotates ribbon 118 counterclockwise through an angle of 180° in the space between rollers 122, 124. Substructures 144*a*–144*d* define a succession of discrete, substantially planar slots, all oriented along common, linear axis 142 between rollers 122, 124, which continuously, smoothly invert ribbon 118 as it travels between the rollers 122, 124. The basic structures of substructures 144a–144d are identical, so the following description of substructure 144a also describes substructures 144b–144d**.

Substructure 144a includes an upper member 148a integral with housing upper portion 16 and a lower member 150a integral with housing lower portion 14. Upper member 148a defines a planar upper ribbon guiding surface 152a, and lower member 150a defines a lower ribbon guiding surface 154a. Upper and lower ribbon guiding surfaces 152a, 154a are parallel to and oppose one another, and define a slot-like ribbon passage 156a therebetween.

The edges of upper and lower members 148a, 150a adjacent to ribbon guiding surfaces 152a, 154a, respectively, are smooth and rounded (not sharp) in the preferred embodiment. The width of ribbon passage 156a is approximately ⅛ of an inch in the preferred embodiment—large enough to prevent folds or bends in ribbon 118 passing therethrough from becoming jammed between upper and lower guiding surfaces 152a, 154a, but small enough to force the ribbon 118 to become oriented in a position parallel to the (mutually parallel) ribbon guiding surfaces 152a, 154a.

Figure 7A:
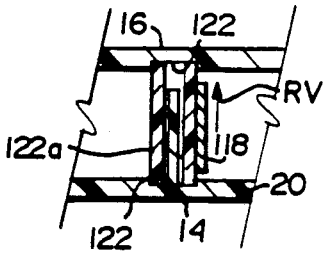
FIGS. 7A–7E are different cross-sectional side views of the ribbon inverter shown in FIGS. 7B–E taken along section lines *7b–7e*, respectively, in FIG. 6.

Referring for a moment to FIGS. 4 and 7A, it can be seen that prior to entering ribbon passage 156a, ribbon 118 is oriented against wall 122a of roller 122 in a position perpendicular to housing upper and lower portions 16, 14 (the ribbon 118 is stored in ribbon storage space 64 in an orientation perpendicular to housing lower portion sheet 20 and normal to the plane of FIG. 4). Ribbon 118 is drawn through slot 62 and around roller 122 while remaining perpendicular to sheet 20 (the cylindrical wall surfaces 122a of the roller 122 contacting the ribbon also are normal to the plane of sheet 20).

Figure 7B:
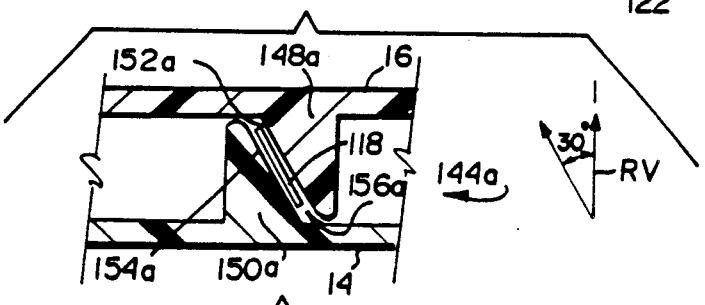

Ribbon 118 next passes through substantially planar, slot-like ribbon passage 156a (as is shown in FIG. 7B). Ribbon guide surfaces 152a, 154a each lie in planes which intersect a reference plane RV normal to the plane PL of sheet 20 (this reference plane being directed upwards toward a viewer looking at FIG. 4) at angles of 30°—causing the ribbon 118 to rotate axially in a counterclockwise direction through an angle of about 30° in the space between roller 122 and substructure 144a. Ribbon 118 exits ribbon passage 156a in a position rotated 30° with respect to the reference vector RV (and the initial ribbon position shown in FIG. 7a).

Figure 7C:
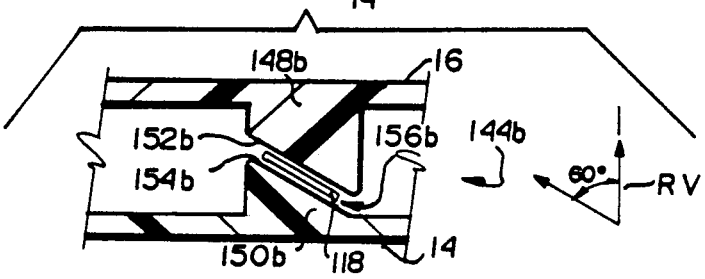
Figure 7D:
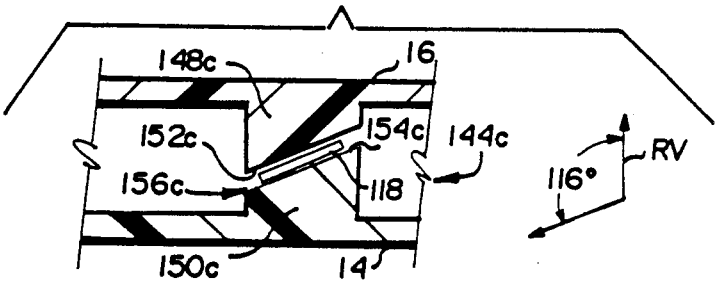

After ribbon 118 exits passage 156a, it passes through the substantially planar, slot-like ribbon passage 156b defined by substructure 144b (shown best in FIG. 7C). Ribbon guide surfaces 152b, 154b each lie in planes which intersect the reference vector RV (mentioned above) at angles of about 60°—causing the ribbon 118 to rotate axially in a counterclockwise direction through an additional angle of 30° in the space between substructures 144a and 144b. Ribbon 118 exits ribbon passage 156b in a position rotated 60° with respect to the reference vector RV (and the initial ribbon position shown in FIG. 7A).

Ribbon 118 passes through substantially planar, slot-like ribbon passage 156c defined by substructure 144c (shown best in FIG. 7D) after it exits passage 156b. Ribbon guide surfaces 152c, 154c each lie in planes which intersect the reference vector RV at angles of about 116°—causing ribbon 118 to rotate axially in a counterclockwise direction through an additional angle of 54° as it travels between substructures 144b and 144c. Ribbon 118 exits ribbon passage 156c in a position rotated 116° with respect to the reference vector RV (and the initial ribbon position shown in FIG. 7a).

Figure 7E:
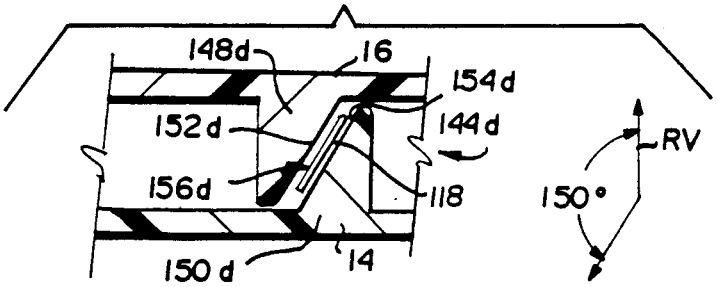

After ribbon 118 exits passage 156c, it passes through substantially planar, slot-like passage 156d defined by substructure 144d between upper and lower members 148d, 150d (best seen in FIG. 7E). Ribbon guide surfaces 152d, 154d each lie in planes which intersect the reference vector RV at angles of about 150°. Ribbon guide surfaces 152d, 154d cause ribbon 118 to rotate axially in a counterclockwise direction through an additional 34° as the ribbon 118 travels between substructures 144c and 144d. Ribbon 118 exits ribbon passage 156d in a position rotated 150° with respect to the reference vector RV (and the initial position of the ribbon 118 shown in FIG. 7a).

Ribbon 118 encounters roller 124 after exiting ribbon passage 156d. The cylindrical ribbon contacting surfaces defined by roller 124 are normal to the plane of housing lower portion sheet 20—and coplanar with reference vector RV. Roller 124 aligns ribbon 118 so that it once again lies in a plane normal to the plane of housing upper and lower portions 16, 14—but oriented in an axially rotated position displaced 180° from the position of ribbon contacting roller 122.

The angles formed between ribbon guide surfaces 152, 154, and the spacings of substructures 144a–144d relative to rollers 122, 124 and one another are chosen, in dependence upon one another, to cause the ribbon 118 to continuously axially rotate through a 180° angular displacement. The angle of rotation $\theta$ of the ribbon 118 at any arbitrary point between rollers 122 and 124 can be calculated according to the following expression:

$$\theta=(L/K)\times 180°,$$

where L is the distance between the ribbon point and roller 122, and K is the total distance between rollers 122, 124. This formula may be used to calculate the angles of ribbon guiding surfaces 152, 154 additional substructures 144 (disposed along axis 146 between rollers 122,124) make with the reference vector, or may be used to calculate the ribbon guide surface angles for any or all of substructures 144a–144d having spacings different from the spacings disclosed.

Figure 8A:
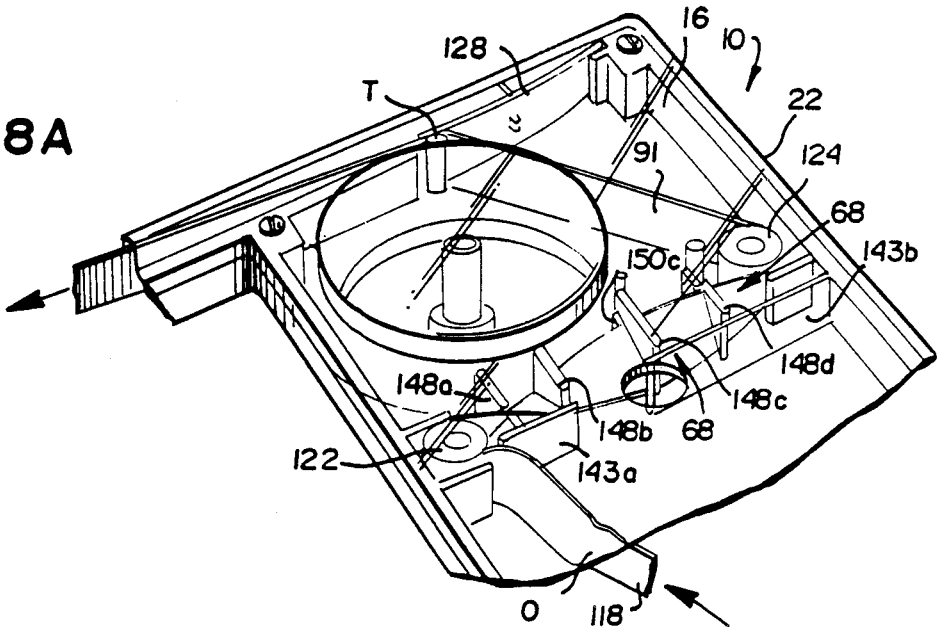
FIG. 8A is a partial elevated view in perspective of the ribbon cartridge shown in FIG. 4 showing in detail how the ribbon inverter inverts a reusable ribbon.
Figure 8B:
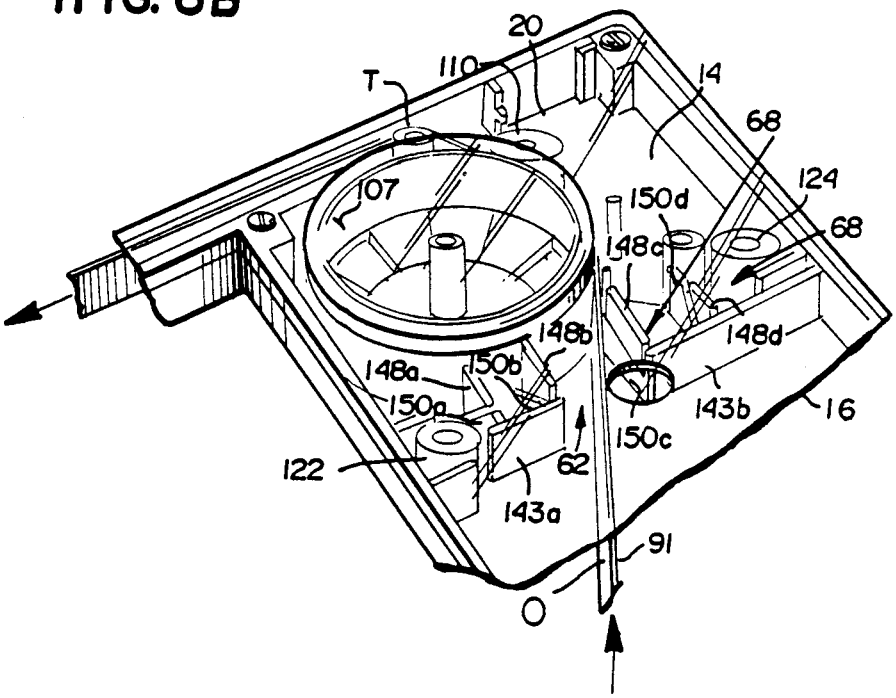
FIG. 8B is a partial elevated view in perspective of the ribbon cartridge shown in FIGS. 2 and 3 showing in detail how the ribbon inverter permits non-reusable ribbon to pass therethrough without inversion.

FIG. 8A shows in detail how reusable ribbon 91 is inverted as it passes through ribbon inverting structure 68 between rollers 122, 124 and along a first path beginning at a point of origin 0 and ending at a point of terminus T. FIG. 8B shows in detail how a non-reusable ribbon 118 is not inverted as it passes through the space between substructures 144b, 144c of ribbon inverting structure 68 along a second path intersecting and crossing the first path (and transverse to the first path), the second path also beginning at origin point O and terminating at terminus point T. Thus, ribbon inverting structure 68 selectively inverts or does not invert ribbon 118 passing through it, depending upon what type of print ribbon is used and how that ribbon is threaded with respect to the multiple ribbon paths defined by the inverting structure 68.

FIGS. 9A and 9B show the ribbon drawing mechanism 72 of the preferred embodiment in detail. As mentioned previously, drawing mechanism 72 includes a main drive gear 78 adapted to be rotated by a source of rotational energy external to cartridge 10, and a pinch wheel 86 in close contact with the drive gear 78. In the preferred embodiment, drive gear 78 has teeth 176 disposed on its outer periphery which mesh with teeth 178 disposed on the outer periphery of pinch wheel 86. These teeth 176, 178 grasp the ribbon 118 between them and draw the ribbon toward storage space 64 as drive gear 78 and pinch wheel 86 rotate together in opposite directions.

Drive housing 80 in the preferred embodiment is stationary with respect, to housing lower portion 14 (the drive housing 80 can be adhered to the lower housing portion 14 with glue or other adhesive, or alternatively, drive spindle 82 may partially extend outside of housing 12 through a cylindrical cavity defined in the housing upper portion 16, preventing drive gear 78 from translating with respect to the housing and providing a knob which can be used to manually advance the ribbon). Pinch wheel housing 84 is pivotable with respect to housing lower portion 14, the pinch wheel housing 84 having a cylindrical pin portion 180 disposed in a partially longitudinally open cylindrical cavity 180*a* to form a trunnion bearing.

Pinch wheel housing 84 is pivotable between a first position (shown in FIG. 9A) whereat pinch wheel teeth 178 mesh with main drive gear teeth 176, and a second position (shown in FIG. 9B) whereat a gap exists between the pinch wheel 86 and the drive gear 78.

A biasing means 87 (e.g., a compression spring disposed between pinch wheel housing 84*a* and an inside surface 183 of lower housing portion wall 22) biases the pinch wheel housing 84 towards the first position.

Rotation of the drive gear in a clockwise direction causes the pinch wheel 86 to rotate in, a counterclockwise direction. A print ribbon 118 disposed between the drive gear 78 and the pinch wheel 86 is drawn into cartridge 10 and is pushed into ribbon storage space 64 as the drive gear 78 rotates.

An inhibiting means 184 measures the length of ribbon 118 which passes through drawing mechanism 72, and causes pinch wheel housing 84 to pivot from the position shown in FIG. 9A to the position shown in FIG. 9B when this metered length exceeds a predetermined length.

In the preferred embodiment, inhibiting means 184 includes a conventional mechanical rotating counter 185 (for example, of the type manufactured by Precipart Corporation of Farmingdale, N.Y.), this counter 185 having an input shaft 186 drive by a toothed input gear 188 and having a digit output shaft 190 with a cam 192 mounted on its end.

Counter 185 is of the type which includes several digit cylinders which rotate in response to rotation of input shaft 186. The "lowest place" digit cylinder of counter 185 may rotate continuously with rotation of input shaft 186. The "next place" digit cylinder rotates by a predetermined angle (e.g., 36° corresponding to one digit for a decade-type counter) for every full rotation of the first digit cylinder. Similarly, any digit cylinder of counter 185 rotates by a predetermined increment (e.g., 36°) for every full rotation of an adjacent digit cylinder corresponding to the next least significant digit.

The most significant digit cylinder of counter 185 is coupled to output shaft 190, and rotates the output shaft 190 (and also cam 192) upon completion of one full rotation of the cylinder corresponding to the second-to-most significant digit of counter 185. The number of digit cylinders included in counter 185 is selected according to the length of ribbon 118 to be metered.

The count of counter 185 is preset n the preferred embodiment so that cam 192 has the initial position shown in FIG. 9A. In this FIG. 9A position, cam 192 does not contact pin wheel housing 84, and biasing means 87 pushes the pinch wheel 86 into close proximity with drive wheel 78 (and also pushes pinch wheel 86 into contact with counter input gear 88). As the drive and pinch wheels 78, 86 rotate together, the pinch wheel 86 causes counter input gear 188 to also rotate—incrementing the count stored in counter 185.

After pinch wheel 86 has rotated a predetermined number of rotations (and a predetermined length of ribbon 118 as been drawn by drive mechanism 72), counter 185 reaches a maximum count (e.g., 9999 for a four-digit decade counter). The number of rotations of input gear 188 needed to cause counter 185 to attain this maximum count is determined by the initial count the counter 185 is preset to, the number of digits counter 185 has, and the circumference of gear 188 relative to the circumference of pinch wheel 86.

In one advantageous embodiment, when counter 185 "rolls over" its count (e.g., counts from 9999 to 0000), cam 192 rotates from the initial position (shown in FIG. 9A) to a new position (shown in FIG. 9B) whereat the cam 192 pushes pinch wheel housing 84 away from drive gear 78 against the force applied by biasing means 87. In the preferred embodiment, rotation of cam 192 causes a gap 199 to form between drive wheel 78 and pinch wheel 86. Thus, rotation of cam 192 forces pinch wheel housing 84 to pivot to a new position different from the initial position of the pinch wheel housing 84. At this new pinch wheel housing position, the print ribbon 118 is not firmly retained between drive wheel 78 and pinch wheel 86, and drive wheel teeth 176 are not engaged with pinch wheel teeth 178. Hence, rotation of drive wheel 78 does not cause pinch wheel 86 to rotate in this new position, and does not cause further ribbon 118 to be drawn by ribbon drawing device 72.

Thus, ribbon drawing device 72 is disabled (inhibited) from drawing further ribbon 118 once pinch wheel 86 (and drive gear 78 in the preferred embodiment) have rotated a predetermined number of times. Counter 185 in the preferred embodiment cannot be reset once cam 192 has rotated—effectively preventing cartridge 10 from dispensing further lengths of ribbon 118 after a predetermined length of ribbon has been dispensed.

The parameters discussed above which determine the number of rotations of pinch wheel 86 occurring before cam 192 rotates are selected so that cartridge 10 is prevented from dispensing further ribbon once the useful life of the ribbon 118 it contains (as corrected for by an additional margin for error) has already been dispensed.

For example, in cartridges which have been adapted for dispensing non-reusable ribbon having a predetermined length x, cam 192 rotates to inhibit further operation of the cartridge after a ribbon length of 1.3x–1.5x has been dispensed.

A reusable, continuous ribbon loop may complete several rotations through cartridge 10 before the ribbon cannot be used further to produce good quality printing. Counter 185 rotates cam 192 from the FIG. 9A position to the FIG. 9B position when a linear length of ribbon corresponding to y*l (where l is the linear length of ribbon comprising the loop and y is the number of complete rotations of the ribbon loop which can occur before the ribbon useful life is at an end) is exceeded. To prevent counter 185 from disabling cartridge 10 while the ribbon is still useful, the value selected for y should be slightly in excess of the number of loop rotations corresponding to maximum useful ribbon life (for example, y might be set to 6.5 or 7 for a fabric ribbon which can be used no more than three times per side with acceptable printing results).

If desired, the same counter 185 can be used for cartridges 10 which are to be disabled after dispensing different ribbon lengths—since the length of ribbon which is dispensed before counter cam 192 rotates can be changed by changing the count to which counter 185 is preset. Alternatively, counters having different numbers of digits can be used for different types of ribbons (reusable and non-reusable) or for ribbons having different longevities.

As can be seen in FIG. 3, cartridge 10 includes a separable ribbon guide/smudge shield 300 ("guide") disengagably mountable on an external surface 302 of cartridge 10 (e.g., an outer surface of wall 22). In the preferred embodiment, slots 304, 306 defined on an exterior surface of wall 22 disengagable retain guide 300. Guide 300 defines a portion of the ribbon path, and the ribbon 118 is threaded through and retained by the guide 300.

During storage, shipping and handling of cartridge 10, guide 300 is engaged with cartridge slots 304, 306—preventing the print ribbon 118 from becoming entangled with and/or contacting external objects.

During operation of cartridge 10, guide 300 is engaged with the printhead 312 of an external printing station (see FIGS. 14–15). Guide 300 performs several functions when engaged with the printhead 312: (1) it aligns the ribbon with the portion of the printhead 312 actually causing printing to occur (e.g., impacting portions of an impact-type printhead 312); and (2) it prevents ribbon 118 from smudging the print medium on its journey between the print head and the medium by interposing a "smudge shield" between the ribbon and the print medium.

FIGS. 10A and 10B are cross-sectional views of ribbon guide 300. Guide 300 includes a member 308 rotatably disposed within the guide and moveable (pivotable) between the position shown in FIG. 10A and the position shown in FIG. 10B. Guide 300 in the preferred embodiment includes a shell 310 of appropriate dimensions for slidably engaging with a printhead 312 (i.e., the shell defines therein a space 314 having dimensions just slightly larger than the outside dimensions of printhead 312, as can best be seen in FIGS. 15–15B). Shell 310 includes engaging means (e.g., flexible tabs or projections 310*a*) which engage with the printhead housing.

A smudge shield 316 (which in the preferred embodiment includes a thin, flexible curved sheet metalized plastic having an aperture 318 defined therethrough) prevents print ribbon 118 from contacting and smudging the print medium while permitting printhead 312 to transfer ink from the print ribbon 118 to the print medium through aperture 318.

Member 308 has two L-shaped portions 320, 322 connected together by a connecting portion 324. L-shaped portions 320, 322 are substantially parallel to and oppose one another. A gap 326 defined between opposing L-shaped portions 320, 322 is wide enough to permit member 308 to "straddle" the housing of printhead 312, with short legs 328, 330 disposed on opposite sides of the printhead housing.

As can best be seen in FIG. 11, connecting portion 324 is shaped in the form of a "U", with legs 332, 334 being flat (and wider than longer legs 336, 338 of L-shaped portions 320, 322). Although L-shaped portions 320, 322 are spaced apart from one another by a sufficient distance to permit printhead 312 to be disposed therebetween, the legs 332, 334 of U-shaped connecting portion 324 are separated by a smaller distance—so that when the L-shaped portions straddle printhead 312, U-shaped connecting portion legs 332, 334 rest on a top surface 340 of printhead 312.

Pivot pins 342, 344 project from L-shaped portion outside surface 346 and L-shaped portion outside surface 348, respectively. Pivot pins 342, 344 are rotatably disposed within corresponding holes defined on opposite walls, of shell 310. Pins 342, 344 enable member 308 to pivot with respect to shell 311 between the position shown in FIG. 10A and the position shown in FIG. 10B.

A resilient "spring" member 350 projects from connecting portion 324 into the space between legs 332, 334. Spring member 350 in the preferred embodiment includes a tab molded to connecting portion 324, this tab being made of acetyl homopolymer manufactured under the trade name DELRIN® by DuPont. As can best be seen in FIG. 13, spring member 350 projects upward from the plane of U-shaped connecting portion 324 (making an angle of perhaps 45° with this plane), but because it is flexible, can be deformed under pressure to lie nearly within the plane of the U-shaped connecting portion 324.

With member 308 pivotably disposed within shell 310, spring member 350 contacts an inside surface 352 of the top of shell 310, and curved end portions 354, 356 contact smudge shield 316 (or ribbon 91 threaded through guide 300 between member 308 and smudge shield 316. Spring member 350 exerts sufficient force on member 308 to cause end portions 354, 356 to exert a retaining force on ribbon 91—this retaining force firmly retaining the ribbon 91 in position between the member 350 and smudge shield 316.

When guide 300 is engaged with printhead 312 (as shown in FIG. 10B and 15–15B), printhead top surface 340 causes member 308 to rotate clockwise from its initial position such that spring member 350 is deformed and connecting portion legs 332, 334 lie parallel to the printhead top surface 340. Member end portions 354, 356 no longer contact ribbon 91 in this position, and the ribbon 91 is free to move in a direction parallel to smudge shield 316 (i.e., directly out of and/or into the plane of FIG. 10B). In the FIG. 10B position, member 308 does not interfere with the movement of ribbon 91.

When guide 300 is once again disengaged from printhead 312, spring member 350 returns to its original shape, rotating member 308 to the position shown in FIG. 10A. Hence, member 308 firmly retains ribbon 91 against smudge shield 316 at all times except when guide 300 is engaged with printhead 312.

While the present invention has been described with what is presently considered to be the most practical and preferred embodiments, it is to be understood that the appended claims are not to be limited to the disclosed embodiments but on the contrary, are intended to cover all modifications, variations and/or equivalent arrangements which retain any of the novel features and advantages of this invention.

What is claimed is:

1. A print ribbon guide comprising:

structure adapted to engage with a printhead of a printer, said structure including guide means for guiding a translating print ribbon along a path between and substantially parallel to (a) a printing surface of said printhead, and (b) a medium to be printed, said structure defining an opening between said printhead and said medium;

said structure comprising a smudge guard disposed across said opening, said smudge guard defining an orifice therethrough in registry with said printhead printing surface; and a member engaged with said structure and movable relative to said structure between a first position whereat said member biases said ribbon in a stationary position against said smudge guard and a second position whereat said member permits said ribbon to freely translate along said path, said member moving to said first position when said structure is disengaged from said printhead, said member moving to said second position when said structure is engaged with said printhead.

2. A print ribbon guide as in claim 1 wherein said member moving comprises member pivoting and further comprising means for automatically biasing said member toward said first position.

3. A print ribbon guide as in claim 1 wherein:

said structure defines a surface substantially perpendicular to said path; and said member comprises a rigid portion having a resilient portion extending therefrom, said resilient portion contacting said perpendicular surface and biasing said rigid portion toward said smudge guard.

4. A print ribbon guide as in claim 1 wherein:

said structure has first and second opposing walls adapted to slide over opposing surfaces of said printhead, said first and second walls both being substantially perpendicular to said path, said first and second walls defining a pair of opposing bores; and said member has first and second pins extending therefrom, said first and second pins being rotatably inserted into said first and second wall bores, respectively.

5. A print ribbon guide as in claim 1 wherein said structure includes means for removeably engaging with an exterior surface of a print ribbon cartridge.

6. A print ribbon guide as in claim 1 wherein said member comprises:

a U-shaped portion having first and second legs joined by a connecting portion;

a first extending portion extending from said U-shaped portion where said first leg joins said connecting portion; and a second extending portion extending from said U-shaped portion where said second leg joins said connecting portion, said second extending portion opposing said first extending portion and being spaced a predetermined distance therefrom.

7. A print ribbon guide as in claim 6 wherein said U-shaped portion is adapted to contact a top surface of said printhead and said first and second extending portions are adapted to straddle said printhead.

8. In a printing apparatus of the type including:

means adapted for holding a medium to be printed, a linear, inked print ribbon, printhead means for selectively transferring ink from said ribbon to said medium, said printhead means including a contacting portion for contacting said ribbon, and ribbon drive means for moving said ribbon rectilinearly past said printhead means along a path disposed between said printhead means contacting portion and said medium, an improved print ribbon guard comprising:

structure slidably engageable with said printhead means, said structure including guide means for guiding said moving ribbon along said path, said structure defining an aperture disposed between said printhead means contacting portion and said medium;

a smudge guard secured to said structure and disposed across said aperture between said ribbon path and said medium said smudge guard defining an opening therethrough in registry with said printhead contacting portion; and ribbon retaining means, engaged with said structure and movable relative to said structure between a first position whereat said retaining means biases said ribbon against said smudge guard and a second position whereat said retaining means permits said ribbon to freely move along said path, said retaining means pivoting to said first position when said structure is disengaged from said printhead means and pivoting to said second position when said structure is engaged with said printhead means.

9. Printing apparatus as in claim 8 further comprising means for biasing said retaining means toward said first position.

10. Printing apparatus as in claim 8 wherein:

said structure defines an interior surface substantially perpendicular to said path; and said retaining means includes a rigid portion and a resilient portion extending from said rigid portion, said resilient portion biasing said rigid portion away from said interior surface and toward said smudge guard.

11. Printing apparatus as in claim 8 wherein:

said structure has first and second opposing walls adapted to slide over corresponding surfaces of said printhead means, said first and second walls defining first and second opposing bores, respectively; and, said retaining means includes first and second pins extending therefrom, said first and second pins being rotatably inserted in said first and second bores, respectively.

12. Printing apparatus as in claim 8 wherein said retaining means comprises:

a U-shaped portion having first and second legs joined by a connecting portion;

a first extending portion extending from said U-shaped portion where said first leg joins said connecting portion; and a second extending portion extending from said U-shaped portion where said second leg joins said connecting portion, said second extending portion opposing said first extending portion and being spaced a predetermined distance therefrom.

13. Printing apparatus as in claim 12 wherein:

said printhead means defines an upper surface, and first and second side surfaces substantially parallel to one another and substantially perpendicular to said upper surface;

said U-shaped portion is adapted to contact said printhead means upper surface; and said first and second extending portions are adapted to straddle said printhead means first and second side surfaces respectively.

14. A print ribbon cartridge including:

structure defining a print ribbon path; and print ribbon guiding means, disposed on said structure along said ribbon path, for defining first and second alternate and crossing longitudinal ribbon branch paths, said first alternate branch path having an origin and a terminus, plural spaced apart ribbon inversion guide elements being disposed along said first path, the orientation of ribbon disposed along said first branch path being axially rotated by said elements approximately 180° degrees at said first branch terminus relative to said ribbon orientation at said first branch origin, said second alternate branch path having an origin and a terminus, the orientation of ribbon disposed along said second branch path crossing said first path without being axially rotated by said elements between said second alternate branch path origin and terminus, said first and second branch paths having at least one intersection point other than said origins and termini.

15. A cartridge as in claim 14, wherein said ribbon guiding means includes plural unequally spaced ribbon rotating means, each said rotating means for rotating said ribbon about its axis, and said second branch path is disposed between two of said ribbon rotating means.

16. A print ribbon cartridge comprising:

a housing having a ribbon inlet port and a ribbon outlet port;

a print ribbon disposed within said housing, a portion of said ribbon exiting said housing through said outlet port and entering said housing through said inlet port;

a first cylindrical post disposed within said housing, said first post defining a first end of a first ribbon path;

a second cylindrical post disposed within said housing and spaced apart from said first post, said second post defining a further end of said first ribbon path;

first ribbon rotating means, disposed along said first path, for axially rotating said ribbon by approximately 90 degrees in a first rotational direction;

second ribbon rotating means, disposed along said first path, for further axially rotating said ribbon by approximately 90 degrees in said first rotational direction, said first and second rotating means defining a gap therebetween; and means disposed within said housing for exhausting ribbon from said housing through said outlet port and for drawing ribbon from said inlet port into said housing, said exhausting/drawing means including selecting means for directing said ribbon to translate over a selected one of (a) said first ribbon path and (b) an alternate ribbon path through said gap transverse to said first path.

17. A print ribbon cartridge comprising:

a housing defining first and second openings and a chamber connecting said first and second openings;

an endless ribbon being divided into first and second connected linear portions, said first portion being disposed within said chamber between said first and second openings, said second portion being disposed outside of said chamber between said first and second openings;

means disposed in said housing and responsive to an applied force for emitting ribbon from said chamber through said first opening and for drawing ribbon into said chamber through said second opening; and means disposed in said housing and coupled to said emitting/drawing means for measuring the length of ribbon emitted from and/or drawn into said chamber and for preventing said emitting/drawing means from emitting further ribbon from said chamber and/or drawing further ribbon into said chamber when said measured length exceeds a predetermined limit;

wherein said emitting/drawing means includes:

a drive wheel rotatably engaged with said housing, a pinch wheel rotatably mounted to said housing and movable between a first position whereat said pinch and drive wheels contact said ribbon therebetween and a second position whereat said drive and pinch wheels are spaced apart from one another;

biasing means connected between said pinch wheel and said housing for biasing said pinch wheel toward said first position; and said measuring/preventing means includes counter means, coupled to one of said pinch and drive wheels, for counting the revolutions of said one wheel and for moving said pinch wheel to said second position when said counted number exceeds a predetermined number.

18. A process for controlling the flow of ribbon through a print ribbon cartridge comprising the steps of:

(1) storing a quantity of print ribbon within said cartridge;

(2) directing a portion of said print ribbon along a ribbon path which extends outside of said cartridge;

(3) detachably affixing said print ribbon portion to a mounting structure integral to said cartridge and disposed on an external surface of the cartridge and thereby preventing said portion from moving along said path;

(4) mating a predetermined male non-circularly symmetric cross-sectional keying/engaging structure disposed on one of the cartridge and a cartridge supporting surface with a corresponding female non-circularly symmetric cross-sectional keying/engaging structure disposed on the other of said cartridge and said supporting surface;

(5) detaching said print ribbon portion from said cartridge external surface;

(6) detachably engaging said print ribbon portion with a printing station;

(7) moving successive portions of said print ribbon along said ribbon path past said printing station;

(8) alternately (a) inverting said ribbon moving along a first subpath within said cartridge, and (b) permitting said ribbon to move along a second subpath intersecting said first subpath without inverting the ribbon;

(9) metering, inside the cartridge, the usage of said ribbon; and

(10) inhibiting said moving step (7) when said metered usage exceeds a predetermined usage;

wherein:

said detachably affixing step (3) includes the step of moving a member disposed within a ribbon guide structure physically separable from said cartridge and enclosing a segment of said ribbon path external to said cartridge to a first position whereat said ribbon is fixedly retained between said member and said guide structure; and said detachably engaging step (6) includes the step of engaging said guide structure with said printing station, thereby moving said member from said first position to a second position whereat a space exists between said member and said guide structure through which said ribbon moves.

19. A ribbon cartridge comprising a restrictor assembly and at least two guides for feeding ribbon through said restrictor assembly, said assembly comprising:

two sets of restrictors, each restrictor set being associated with a respective guide, said restrictor sets for feeding ribbon along a ribbon path between said two guides, each set comprising at least two restrictors, said restrictors being dimensioned so as to progressively invert the ribbon along said ribbon path to a total ribbon inversion of 180 degrees, and means for providing a substantial gap between said two restrictor sets, the ribbon path distance from one of the guides to the remote restrictor of its associated set being greater than the ribbon path distance from the other guide to the remote restrictor of its associated set, and the ribbon path distance between said sets of restrictors being greater than the distance between the restrictors of each set.

20. A ribbon cartridge as in claim 19 wherein a second ribbon path is provided through said gap, said gap being dimensioned to accommodate the passage of ribbon arriving at various angles to the ribbon path between said guides along said first-mentioned ribbon path.

21. A ribbon cartridge including:

first and second restrictor means together defining a first ribbon path therebetween having a first length W1 for rotating ribbon along said first ribbon path by a first angle; and third and fourth restrictor means together defining a second ribbon path therebetween having a length W3 for rotating ribbon along said second ribbon path by a second angle, wherein said second and third restrictor means have a gap therebetween and together define a further ribbon path across said gap having a further length W2 substantially greater than either of said first and second lengths, said second and third restrictor means also for rotating ribbon along said further path by a further angle, the sum of said first, second, and further angles being substantially equal to 180 degrees.

22. A ribbon cartridge as in claim 21 wherein an alternate ribbon path is provided through said gap, said gap being dimensioned to accommodate the passage of ribbon arriving at various angles to said further ribbon path.

* * * * *